US008281954B2

(12) United States Patent
Stern et al.

(10) Patent No.: US 8,281,954 B2
(45) Date of Patent: Oct. 9, 2012

(54) SENSORY AROMA GLASS

(75) Inventors: Lewis Stern, Modesto, CA (US); Meara Kelley, Modesto, CA (US); Tim Ryan, Modesto, CA (US)

(73) Assignee: E. & J. Gallo Winery, Modesto, CA (US)

( * ) Notice: Subject to any disclaimer, the term of this patent is extended or adjusted under 35 U.S.C. 154(b) by 398 days.

(21) Appl. No.: 12/618,455

(22) Filed: Nov. 13, 2009

(65) Prior Publication Data

US 2011/0114654 A1 May 19, 2011

(51) Int. Cl.
*A47G 19/22* (2006.01)

(52) U.S. Cl. ..... 220/703; 220/711; 220/712; 220/719; 220/745

(58) Field of Classification Search ..... 220/703, 220/711, 712, 719, 745; 99/277
See application file for complete search history.

(56) References Cited

U.S. PATENT DOCUMENTS 5,720,412 A * 2/1998 Ficken ..... 220/703
5,758,797 A * 6/1998 Martindale ..... 220/719
6,277,422 B1 * 8/2001 Gale ..... 426/115

* cited by examiner

*Primary Examiner* — Anthony Stashick
*Assistant Examiner* — Madison L Wright
(74) *Attorney, Agent, or Firm* — Sanjeet Dutta; King & Spalding LLP

(57) ABSTRACT

A sensory aroma glass is disclosed. According to one embodiment, an apparatus comprises a fluid barrier; and a fluid container designed for containing a fluid. The fluid barrier is in contact with the rim or internal or external sidewall of the fluid container. The fluid barrier extends into the fluid container. The fluid barrier has an opening that allows aroma of the fluid to escape from the fluid container without allowing the fluid to escape from the fluid container.

17 Claims, 6 Drawing Sheets

SENSORY AROMA GLASS

FIELD

The present invention relates to a container for fluids. In particular, the present apparatus and methods are directed to a sensory aroma glass.

BACKGROUND

Prior devices include a variety of drinking vessels that allow for improved olfaction from the vessel during consumption of a beverage, and vessel covers which prevent insects from contacting the liquid contents.

One prior device is a drinking glass having the dual purpose of providing, in addition to drinking therefrom, the ability to sample the aroma emitted from the beverage. The device has at least one inner element inside the drinking glass dividing the glass into a drinking compartment and an aroma compartment. This allows the aroma of the beverage to be sampled from the aroma compartment while consuming the beverage from the drinking compartment.

Another prior device is a drinking glass which allows for improved olfaction from the glass in addition to drinking therefrom. The rim of the glass has a cut-out section to create a facial profile to receive the nose.

Another prior device is a cover for a container which will allow liquid contents to exit while preventing intrusion of insects. The cover has a plastic screen which is attachable and detachable from the upper rim of the container.

Another prior device has an improved cover for a container which allows liquid contents to exit while preventing the intrusion of insects. The cover has an annular guard formed with a downwardly extending skirt and an orthogonally upwardly positioned rim including a screen matrix tapering downwardly to meter flow of beverage through the openings.

SUMMARY

A sensory aroma glass is disclosed. According to one embodiment, an apparatus comprises a fluid barrier; and a fluid container having a rim and side wall and is designed for containing a fluid. The fluid barrier is in contact with the rim or internal or external side wall of the fluid container. The fluid barrier extends into the fluid container. The fluid barrier has an opening that allows an aroma of the fluid to escape from the fluid container without allowing the fluid to escape from the fluid container, even when tipped in any direction.

The above and other preferred features, including various novel details of implementation and combination of elements, will now be more particularly described with reference to the accompanying drawings and pointed out in the claims. It will be understood that the particular methods and circuits described herein are shown by way of illustration only and not as limitations. As will be understood by those skilled in the art, the principles and features described herein may be employed in various and numerous embodiments without departing from the scope of the invention.

BRIEF DESCRIPTION OF THE DRAWINGS

The accompanying drawings, which are included as part of the present specification, illustrate the presently preferred embodiment of the present invention and together with the general description given above and the detailed description of the preferred embodiment given below serve to explain and teach the principles of the present invention.

Figure 1A:
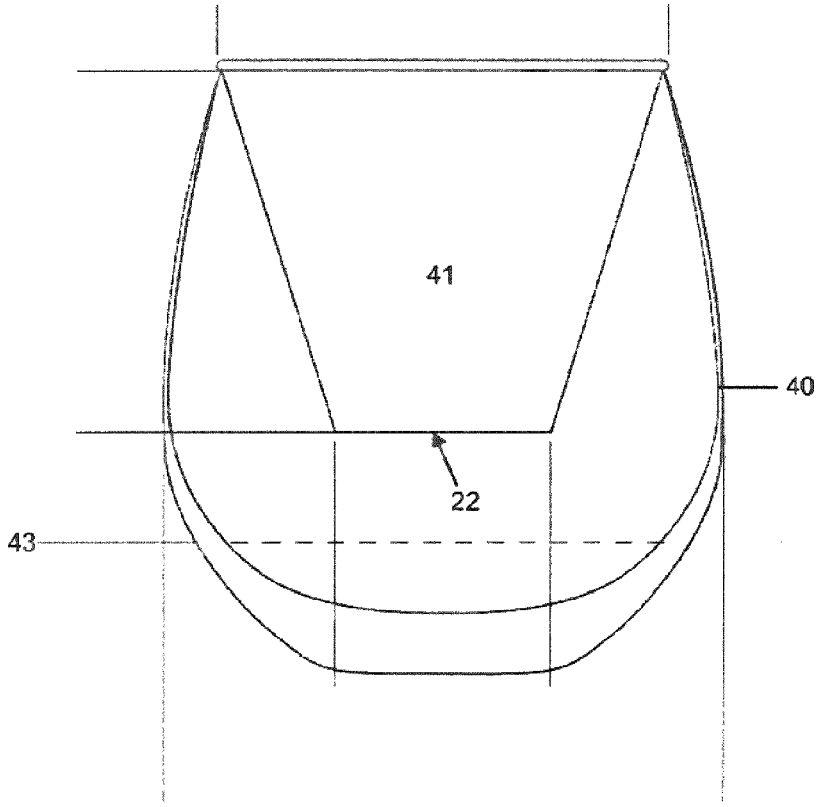
FIG. 1A illustrates a side view of a sensory aroma glass, according to one embodiment.

It should be noted that the figures are not necessarily drawn to scale and that elements of similar structures or functions are generally represented by like reference numerals for illustrative purposes throughout the figures. It also should be noted that the figures are only intended to facilitate the description of the various embodiments described herein. The figures do not describe every aspect of the teachings described herein and do not limit the scope of the claims.

DETAILED DESCRIPTION

A promotional tool in the form of a drinking glass with a barrier that allows consumers to view and smell the liquid contents of the glass, but prevents consumers from consuming the liquid contents. The fluid container has the shape and appearance of a conventional glass but has a unique conical barrier which prevents consumption of any liquid contents.

Three important aspects of initial purchase and repeat purchase of wine, spirit, and malt beverages are the product appearance, aroma and taste. When promoting such beverages, there may be instances where it is desirable to allow consumers to both view the beverage and sample its aroma, while preventing the consumer from actually tasting or consuming the beverage. Case examples where such a promotional tool is useful include states where tasting/sampling of alcoholic beverages is subject to regulatory constraints, or instances where the promotion location is not zoned/licensed for sale/consumption of alcoholic beverages.

According to one embodiment, the present apparatus provides a fluid container manufactured with a fluid barrier which prevents the beverage from escaping or being extracted, while permitting the aroma of the beverage to pass through. The interior of the fluid container manufactured with a conical barrier.

According to one embodiment, the present apparatus provides a reusable fluid container and fluid barrier set which prevents the beverage from escaping or being extracted while permitting only the aroma of the beverage to pass through. The fluid barrier being attachable and detachable from the fluid container.

According to one embodiment, the present apparatus provides a universally sized fluid barrier for drinking glasses, such as traditional long stem wine glasses, tumblers, sifters, goblets, brandy glasses, etc. The universally sized fluid barrier inserts into a glass and adhesively seals onto the glass's rim or internal or external side wall. The fluid barrier has a stepped conical shape for various glass openings which prevents the beverage from escaping or being extracted, while permitting the aroma of the beverage to pass through.

According to one embodiment, a sensory aroma glass can be sealed for a prefilled beverage product.

When a fluid container and fluid barrier are used in combination, the combination is referred hereinafter as a sensory aroma glass.

FIG. 1A illustrates a side view of a sensory aroma glass, according to one embodiment. Preferably, a fluid container 40 with a fluid barrier 41 is molded from a single piece of material. Alternatively, the fluid container 40 and fluid barrier 41 are two separate pieces that are welded together to form a single piece; a sensory aroma glass. The conical shape of the fluid barrier 41 prevents consumption of the liquid contents of the fluid container 40. The bottom 22 of the fluid barrier 41 may be open or partially covered to allow the aroma to escape and is shown in greater detail in FIGS. 2A-C. According to one embodiment, the fluid container 40 has a fill-mark 43 which indicates the maximum level at which the fluid container 40 may be filled in order for the fluid barrier 41 to function properly.

Figure 1B:
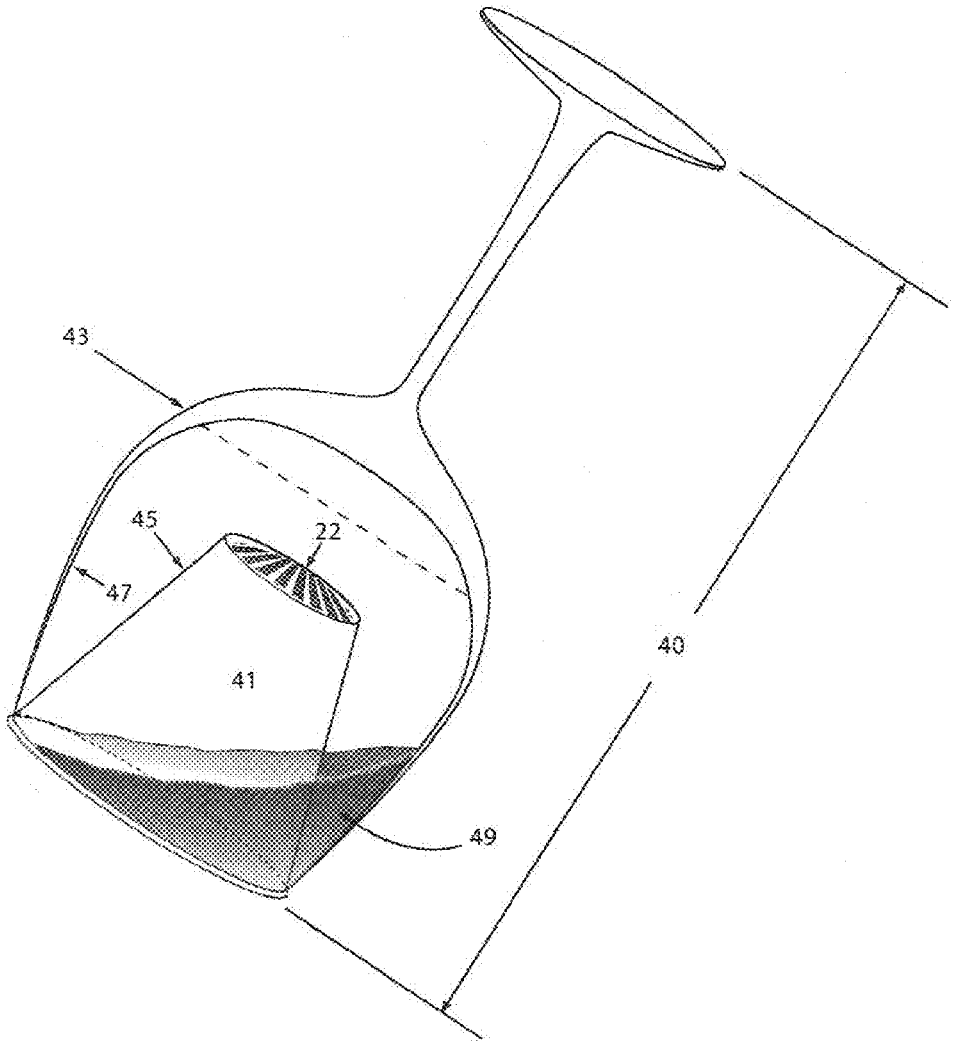
FIG. 1B illustrates a perspective view of a sensory aroma glass in practice, according to one embodiment.

FIG. 1B illustrates a perspective view of sensory aroma glass in practice, according to one embodiment. The sensory aroma glass is shown tilted at such an angle that liquid contents 49 would escape from a conventional drinking glass. The conical shape of the fluid barrier 41 prevents consumption of the liquid contents 49 of the fluid container 40 by trapping the liquid contents 49 between the outer wall 45 of the fluid barrier 41 and the internal side wall 47 of the fluid container 40 when tipped in any direction and at any angle. The fluid barrier 41 prevents the liquid contents 49 from escaping even if the fluid container 40 is turned completely upside down. As shown in this exemplary illustration, the bottom 22 of the fluid barrier 41 is partially covered by a sieve type cover to prevent extraction of liquid contents 49. According to one embodiment, the fluid container 40 has a fill-mark 43 which indicates the maximum level at which the fluid container 40 may be filled in order for fluid barrier 41 to function properly.

Figure 2A:
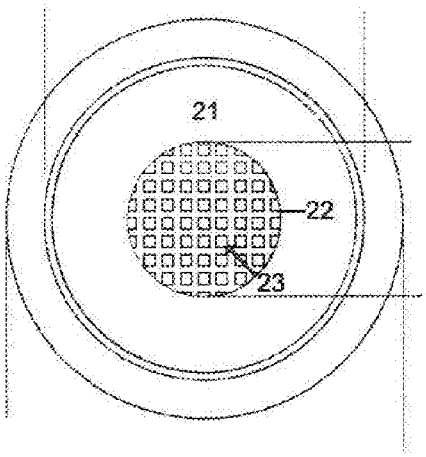
FIG. 2A illustrates a top view of a fluid barrier with a sieve type bottom cover, according to one embodiment.
Figure 2B:
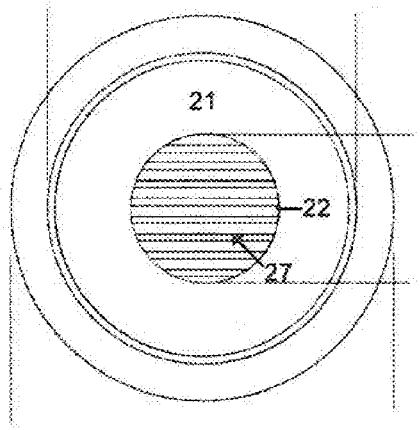
FIG. 2B illustrates a top view of a fluid barrier with a rail bottom cover, according to one embodiment.
Figure 2C:
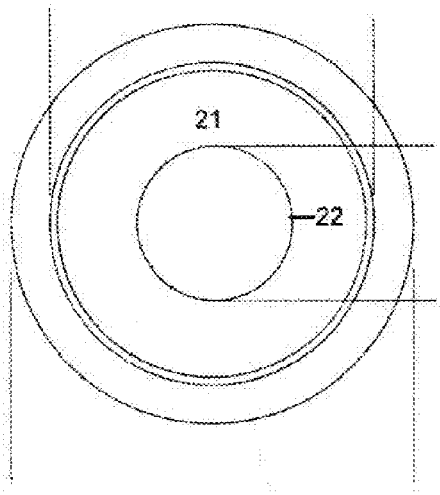
FIG. 2C illustrates a top view of a fluid barrier with an open bottom, according to one embodiment.

FIG. 2A illustrates a top view of a fluid barrier with a sieve type bottom cover, according to one embodiment. The bottom 22 of the fluid barrier 21 is flat with small holes 23 (sieve type cover) which allows aroma vapor to escape but prevents the beverage from escaping or being extracted (e.g. by way of a straw). The holes 23 should be sized and spaced such that the bottom 22 of the fluid barrier 21 is porous enough to permit the aroma of the liquid contents to pass through but impermeable enough that it is difficult to extract the liquid contents. FIG. 2B illustrates a top view of a fluid barrier with a rail bottom cover, according to one embodiment. Rather than a sieve type cover, the bottom 22 of the fluid barrier 21 is partially covered by rails 27. Persons skilled in the art will recognize other designs that will achieve this end. FIG. 2C illustrates a top view of a fluid barrier with a bottom 22 that is completely open, according to one embodiment. The bottom 22 of the barrier 21 is left open to allow for maximum aromatization.

Figure 3:
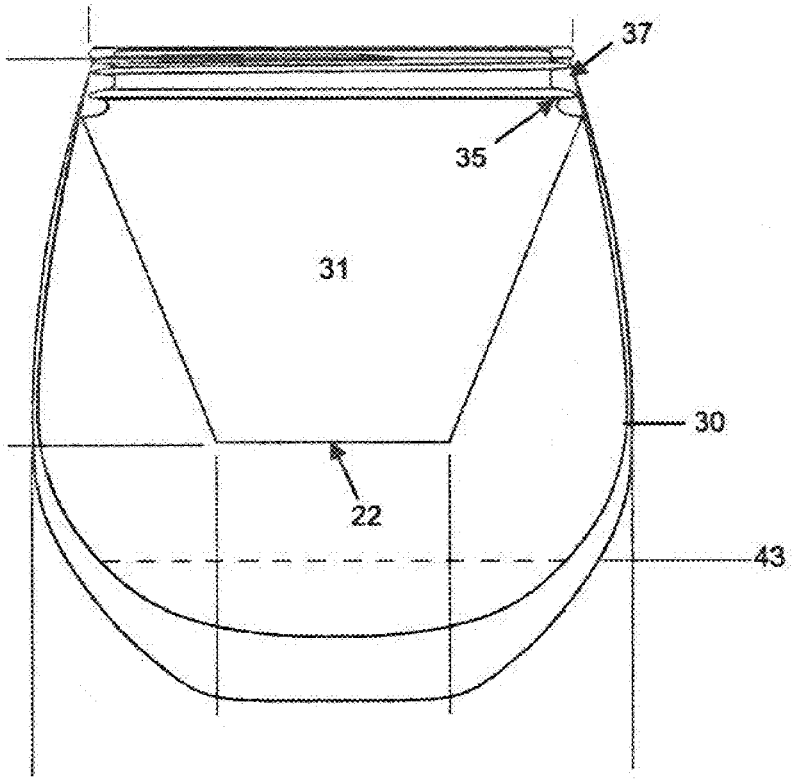
FIG. 3 illustrates a side view of an attachable and detachable fluid barrier, according to one embodiment.

FIG. 3 illustrates a side view of an attachable and detachable fluid barrier, according to one embodiment. The fluid barrier 31 and fluid container 30 are part of a set. The fluid barrier 31 is conical in shape and attaches to the fluid container 30. According to one embodiment, the fluid barrier 31 and the fluid container 30 are both threaded 35 and 37 such that the fluid barrier 31 screws into the fluid container 30. Persons skilled in the art will recognize other ways of making fluid barrier 31 attachable to fluid container 30. According to the preferred embodiment, the fluid container 30 is reusable while the fluid barrier 31 is reusable or disposable. Once attached to the fluid container 30, the conical shape of the fluid barrier 31 seals and prevents consumption of liquid contents in the fluid container 30. The bottom 22 of the fluid barrier 31 may be open or partially covered and is shown in greater detail in FIGS. 2A-C. According to one embodiment, the fluid container 30 has a fill-mark 43 which indicates the maximum level at which the fluid container 30 may be filled in order for the fluid barrier 31 to function properly.

Figure 4:
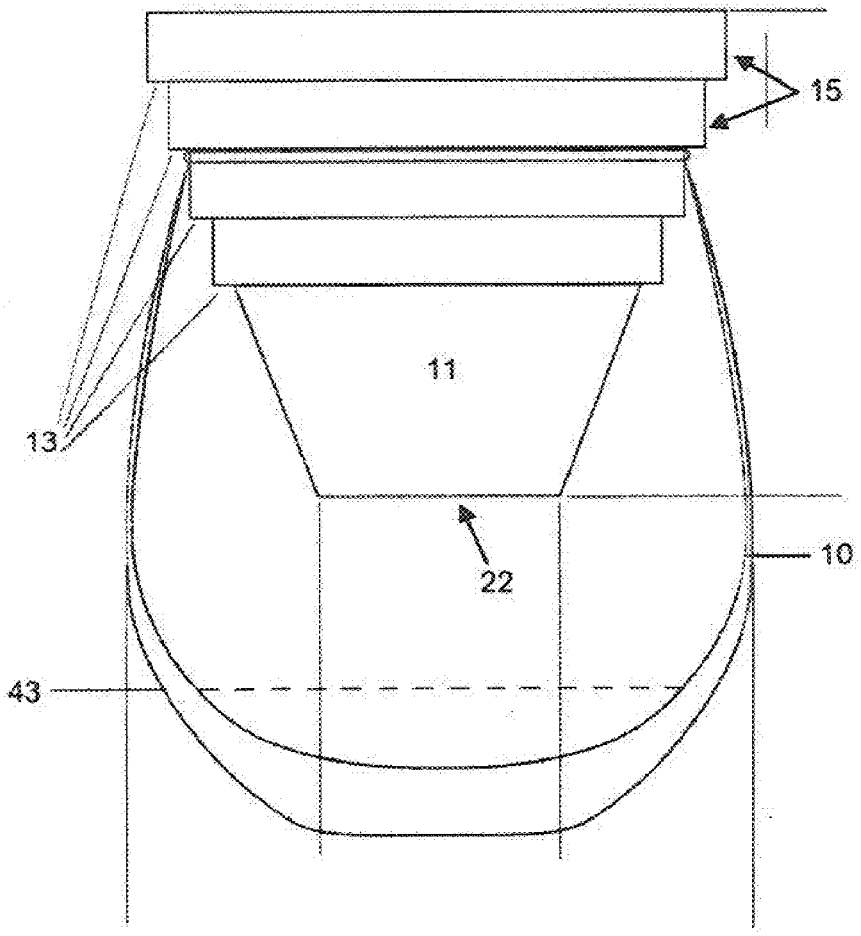
FIG. 4 illustrates a side view of a fluid barrier inserted into a glass, according to one embodiment.

FIG. 4 illustrates a side view of a fluid barrier inserted into a glass, according to one embodiment. The fluid barrier 11 has a stepped conical shape so that it can fit a variety of glass shapes and sizes. A wine glass 10 is shown in FIG. 4 but the barrier 11 is intended for use with any glass or cup shape. The steps 15 of fluid barrier 11 have a layer of adhesive 13 so that the barrier 11 can bond with the rim or internal or external side wall of the glass 10. Once adhesively sealed to a glass, the conical shape of the fluid barrier 11 prevents consumption of the contents of the glass 10. The bottom 22 of the fluid barrier 11 may be open or partially covered to allow the aroma to escape and is shown in greater detail in FIGS. 2A-C. According to one embodiment, the glass 10 has a fill-mark 43 which indicates the maximum level at which the glass 10 may be filled in order for fluid barrier 11 to function properly.

Figure 5:
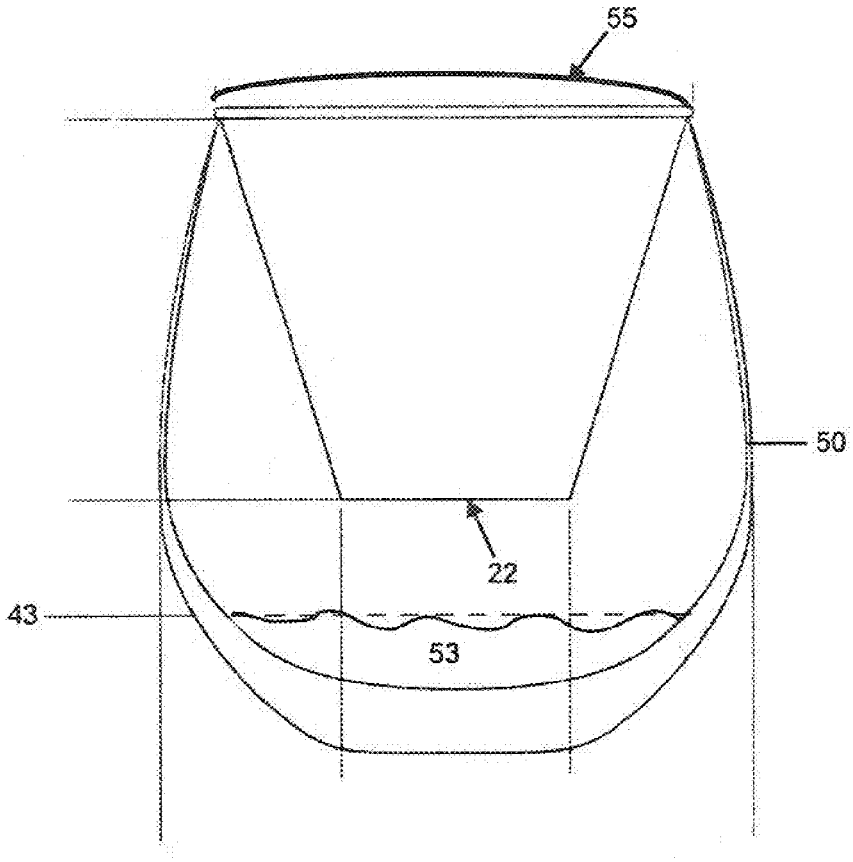
FIG. 5 illustrates a side view of a sensory aroma glass sealed with prefilled beverage product.

FIG. 5 illustrates a side view of the sensory aroma glass sealed with prefilled beverage product. According to this embodiment, the sensory aroma glass 50 is sealed with a removable or breakable seal 55 for prefilled beverage product 53. Those skilled in the art will recognize different methods and materials for sealing a sensory aroma glass 50.

Preferably, the material used to construct the apparatus is clear so that the liquid contents can be seen at the same time as the aroma is sampled; however, this is not a requirement. The apparatus may be constructed of glass, polymers, including, but not limited to polyethylene terephthalate (PET), high density polyethylene (HDE), polyvinyl chloride (PVC), low density polyethylene (LDPE), polypropylene (PP), polycarbonate, aluminum, paper based material or composite material. These are few examples of materials that may be used and are not intended as an exhaustive list. Those skilled in the art will recognize other materials for construction of apparatus.

There are a variety of methods in which the apparatus may be implemented. According to one embodiment, the fluid container and fluid barrier are manufactured as separate pieces. A fluid container is fitted with a fluid barrier after the beverage product is portioned into the fluid container. For example, at the promotion location. As described above, the fluid barrier may be universally sized for any drinking glass, or come as part of a fitted fluid container/barrier set. Further, either the fluid barrier or fluid container may be reusable or disposable. According to another embodiment, a fluid container and a fluid barrier are manufactured as a single piece. For instance, the fluid container and fluid barrier may be manufactured as two pieces that are later welded or bonded together to form a single piece; a sensory aroma glass. According to this embodiment, the sensory aroma glass may be prefilled with beverage product, or the beverage product may be portioned into the sensory aroma glass on site.

A sensory aroma glass has been described. It is understood that the embodiments described herein are for the purpose of elucidation and should not be considered limiting the subject matter of the disclosure. Various modifications, uses, substitutions, combinations, improvements, methods of productions without departing from the scope or spirit of the present invention would be evident to a person skilled in the art.

We claim:

1. An apparatus comprising:

a fluid barrier; and a fluid container having a rim and side wall;

wherein the fluid barrier in contact with the rim or internal or external side wall of the fluid container, extends into the fluid container, and has an opening that allows an aroma of a fluid to escape from the fluid container without allowing the fluid to escape from the fluid container even when tipped in any direction; and wherein the apparatus is prefilled with fluid for aroma sampling and is vacuum sealed.

2. The apparatus of claim 1, wherein the fluid barrier is cone shaped.

3. The apparatus of claim 1, wherein the opening includes a sieve cover.

4. The apparatus of claim 1, wherein the opening includes a inter-crossing rail cover.

5. The apparatus of claim 1,wherein the fluid container includes a fill line.

6. The apparatus of claim 1, wherein the fluid container and the fluid barrier screw together.

7. An apparatus comprising:

a fluid barrier;

wherein the fluid barrier has a stepped conical shape to fit a variety of drinking glass shapes and sizes, the fluid barrier including steps each having a layer of adhesive so that the fluid barrier can bond with an external side wall of a drinking glass, and wherein the fluid barrier extends into the drinking glass and has an opening that allows an aroma of a fluid to escape.

8. The apparatus of claim 7, wherein the opening includes a sieve cover.

9. The apparatus of claim 7, wherein the opening includes an inter-crossing rail cover.

10. The apparatus of claim 7, wherein the fluid container includes a fill line.

11. The apparatus of claim 7, wherein the apparatus is prefilled with fluid for aroma sampling and is vacuum sealed.

12. A method, comprising:

portioning a fluid in a fluid container, wherein the fluid container is prefilled with fluid for aroma sampling and is vacuum sealed; and fitting the fluid container with a fluid barrier, wherein the fluid barrier is in contact with a rim of the fluid container, extends into the fluid container, and has an opening that allows an aroma of the fluid to escape without allowing the fluid to escape from the fluid container when tipped in any direction.

13. The method of claim 12, wherein the fluid barrier is cone shaped.

14. The method of claim 12, wherein the opening includes a sieve cover.

15. The method of claim 12, wherein the opening includes a inter-crossing rail cover.

16. The method of claim 12, wherein the fluid container includes a fill line.

17. The method of claim 12, wherein the fluid container and the fluid barrier screw together.

* * * * *